US008496073B2

(12) United States Patent
Eisenhardt et al.

(10) Patent No.: US 8,496,073 B2
(45) Date of Patent: Jul. 30, 2013

(54) PORTABLE POWER TOOL

(75) Inventors: Armin Eisenhardt, Bisingen (DE); Horst Fahrner, Stuttgart (DE)

(73) Assignee: AEG Electric Tools GmbH, Winnenden (DE)

( * ) Notice: Subject to any disclaimer, the term of this patent is extended or adjusted under 35 U.S.C. 154(b) by 796 days.

(21) Appl. No.: 12/091,649

(22) PCT Filed: Oct. 29, 2005

(86) PCT No.: PCT/EP2005/011601
§ 371 (c)(1),
(2), (4) Date: Apr. 25, 2008

(87) PCT Pub. No.: WO2007/048435
PCT Pub. Date: May 3, 2007

(65) Prior Publication Data
US 2008/0223594 A1 Sep. 18, 2008

(51) Int. Cl.
*B25D 17/04* (2006.01)

(52) U.S. Cl.
USPC ..... 173/162.2; 173/162.1

(58) Field of Classification Search
USPC ..... 173/162.1, 162.2; 16/421, 422, 430, 16/431
See application file for complete search history.

(56) References Cited

U.S. PATENT DOCUMENTS

| | | | | |
|---|---|---|---|---|
| 4,837,892 | A * | 6/1989 | Lo | 16/431 |
| 4,936,394 | A * | 6/1990 | Ohtsu | 173/162.2 |
| 5,046,566 | A * | 9/1991 | Dorner et al. | 173/162.2 |
| 5,052,500 | A * | 10/1991 | Ohtsu | 173/162.2 |
| 5,115,530 | A * | 5/1992 | Distiso | 15/25 |
| 5,157,807 | A * | 10/1992 | Keller et al. | 16/431 |
| 5,394,039 | A * | 2/1995 | Suchdev et al. | 310/51 |
| 5,398,414 | A * | 3/1995 | Neubert et al. | 30/124 |
| 5,466,183 | A * | 11/1995 | Kirn et al. | 451/359 |
| 5,640,741 | A * | 6/1997 | Yano | 16/421 |
| 5,692,574 | A | 12/1997 | Terada | |
| 5,769,174 | A * | 6/1998 | Lee et al. | 173/162.2 |
| 6,026,910 | A * | 2/2000 | Masterson et al. | 173/162.2 |
| 6,148,930 | A | 11/2000 | Berger et al. | |
| 6,185,786 | B1 * | 2/2001 | Garcia | 16/430 |
| 6,220,367 | B1 | 4/2001 | Masterson et al. | |
| 6,412,180 | B1 * | 7/2002 | Wolf et al. | 30/381 |
| 6,619,409 | B2 * | 9/2003 | Iida | 173/162.2 |
| 6,719,067 | B2 * | 4/2004 | Taga | 173/93.5 |

(Continued)

FOREIGN PATENT DOCUMENTS

| | | | |
|---|---|---|---|
| DE | 100 36 078 | A1 | 2/2002 |
| DE | 100 55 395 | A1 | 5/2002 |
| WO | WO 2004/039541 | A1 | 5/2004 |

*Primary Examiner* — Hemant M Desai
*Assistant Examiner* — Gloria R Weeks
(74) *Attorney, Agent, or Firm* — Foley & Lardner LLP

(57) ABSTRACT

The invention relates to a portable power tool having a motor housing (1) and a separate handle housing (3) fastened to the motor housing (1) by means of an elastic vibration damper (2) and secured thereon in a positive-locking manner. The vibration damper (2) is composed of a fastening sleeve (4) assigned to the motor housing (1), an elastic damping sleeve (5) coaxially enclosing the fastening sleeve (4) and a handle holder (6) likewise coaxially enclosing the fastening sleeve (4) and the damping sleeve (5) and assigned to the handle housing (3). The essentially rigid construction unit consisting of the handle holder (6) and the handle housing (3) is secured in a positive-locking manner, with play, directly to the essentially rigid construction unit consisting of the fastening sleeve (4) and the motor housing (1).

18 Claims, 4 Drawing Sheets

U.S. PATENT DOCUMENTS 7,118,492 B2 * 10/2006 Hung ..... 473/300
7,204,744 B2 * 4/2007 Lamprecht et al. ..... 451/357
7,217,178 B2 * 5/2007 Oki et al. ..... 451/359
7,252,156 B2 * 8/2007 Sugiyama et al. ..... 173/162.1
7,303,026 B2 * 12/2007 Frauhammer et al. ..... 173/48
7,472,760 B2 * 1/2009 Stirm et al. ..... 173/162.1
7,517,276 B2 * 4/2009 Kuragano et al. ..... 451/359
7,523,790 B2 * 4/2009 Arakawa et al. ..... 173/162.2
7,537,065 B2 * 5/2009 Gallagher et al. ..... 173/170
7,721,818 B2 * 5/2010 Inagawa et al. ..... 173/162.2
2004/0016082 A1 * 1/2004 Yi ..... 16/421
2006/0086515 A1 * 4/2006 Engelfried ..... 173/162.2
2006/0113098 A1 * 6/2006 Inagawa et al. ..... 173/162.2
2006/0219419 A1 * 10/2006 Sugiyama et al. ..... 173/162.2
2007/0034397 A1 * 2/2007 Fischer et al. ..... 173/162.2
2007/0289763 A1 * 12/2007 Wiker et al. ..... 173/162.2
2008/0245197 A1 * 10/2008 Martinek et al. ..... 81/489
2008/0277130 A1 * 11/2008 Kurzenberger et al. ... 173/162.2
2009/0283283 A1 * 11/2009 Oesterle et al. ..... 173/162.2

* cited by examiner

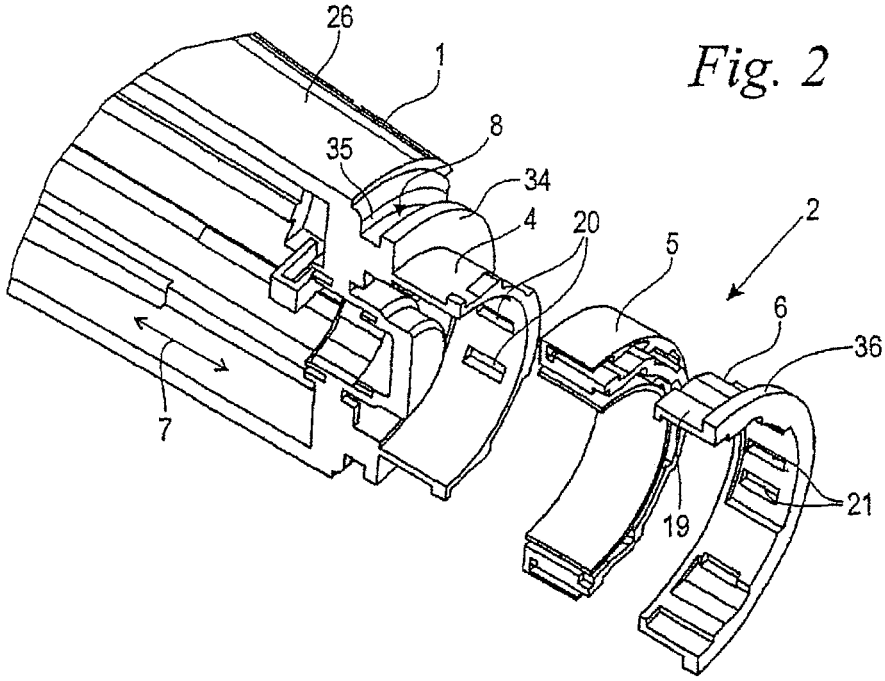
Fig. 2
Fig. 3
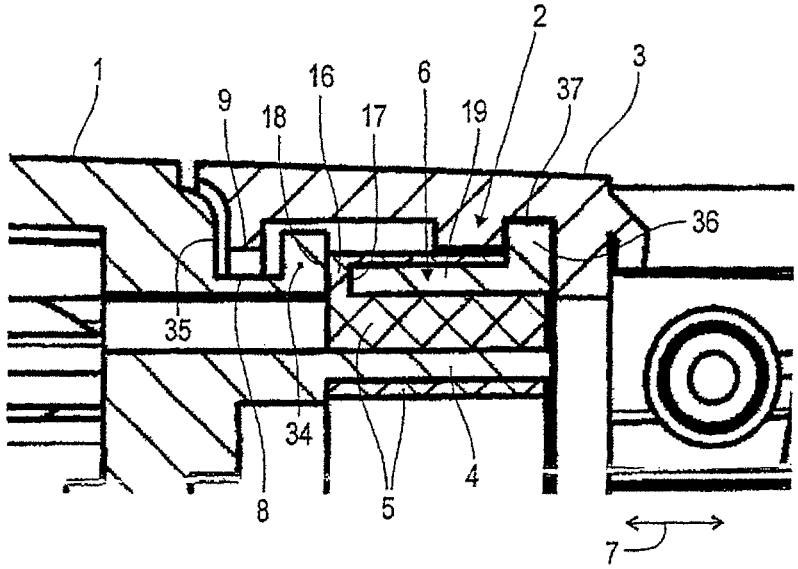

*Fig. 4*
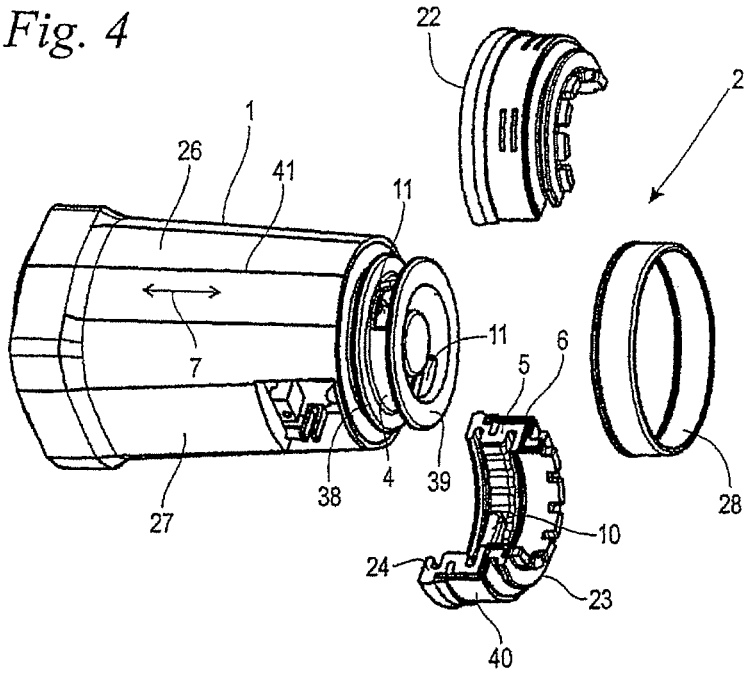
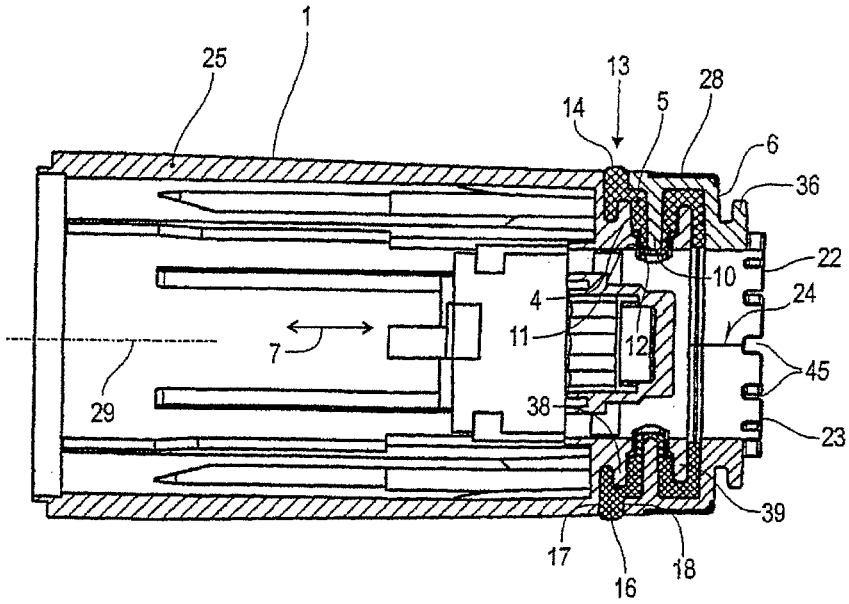
*Fig. 5*

*Fig. 6*
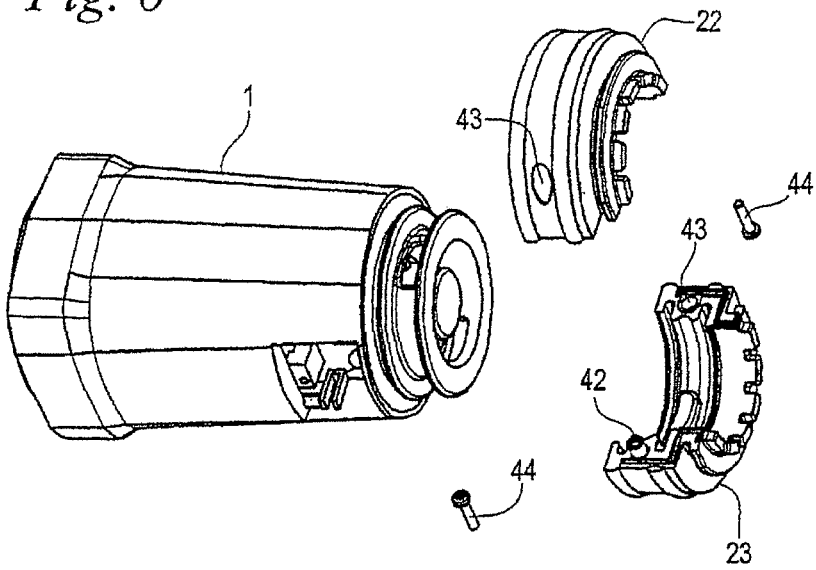
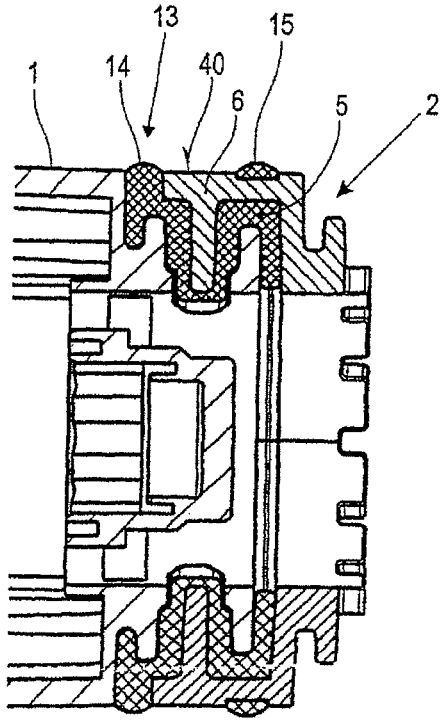
*Fig. 7*

PORTABLE POWER TOOL

The invention relates to a portable power tool having a motor housing and a separate handle housing fastened to the motor housing by means of an elastic vibration damper and secured thereon in a positive-locking manner.

Such a power tool is known from WO 2004/039541 A1. In order for vibrations that occur during operation of such a power tool to be kept away from the handle housing, the said publication proposes a vibration damper which comprises a holder on the motor housing side and a receiving plate on the handle housing side, between which holder and receiving plate an annular damping element is arranged in the axial direction. The three components of the vibration damper are layered upon one another in the axial direction, and a number of screw-like securing elements extend through them in the axial direction. The receiving plate is secured to the securing elements in a positive-locking manner. The rear handle held on the receiving plate is prevented from becoming detached from the motor housing in the event of the damping element being damaged.

The aforementioned arrangement requires a substantial structural space in the axial and radial directions and is of a complicated structure. The soft damping element is unprotected in the circumferential region and during operation is exposed to the severe ambient conditions prevailing in that region.

The invention is based on the object of developing a power tool of the generic type so as to ensure a damping and securing function with a simplified structure.

This object is achieved by a portable power tool having the features of claim 1.

There is proposed for this purpose a portable power tool wherein the vibration damper is constructed from a fastening sleeve assigned to the motor housing, from an elastic damping sleeve which coaxially encompasses the fastening sleeve, and from a handle holder which likewise coaxially encompasses the fastening sleeve and the damping sleeve and is assigned to the handle housing. The substantially rigid structural unit consisting of the handle holder and the handle housing is secured in a positive-locking manner, with play, directly to the substantially rigid structural unit consisting of the fastening sleeve and the motor housing. In the case of the proposed coaxial structural design of the vibration damper, the fastening sleeve, the elastic damping sleeve and the handle holder are layered in the radial direction, which permits a thin-walled structural design. The fact that the substantially rigid structural unit consisting of the handle holder and the handle housing is secured in a positive-locking manner, with play, to the likewise substantially rigid structural unit consisting of the fastening sleeve and the motor housing permits a free, elastic, vibration-damping relative deformation between the two rigid structural units, and thereby an effective vibration decoupling. The positive locking with play secures the handle housing to the motor housing without impeding the vibration decoupling. The direct, positive-locking securing system between the two aforementioned structural units makes it possible to dispense with the use of additional securing elements. In particular, the vibration damper does not need to have any geometric adaptation in order to receive such securing elements, which is conducive to reduction of its structural volume. The damping sleeve can be designed solely from the point of view of the damping effect required, without its function being impaired by separate securing elements.

In an advantageous embodiment, the handle housing overlaps the vibration damper in an axial direction in the direction of the motor housing, and is secured, with play, directly to the motor housing. In this case, the protective chain consists of only two elements, namely the handle housing and the motor housing, whilst all other elements, such as the fastening sleeve, the damping sleeve and the handle holder, have been taken out of this securing chain. The securing function achieved is not limited merely to damage in the damping sleeve, but also covers damage on the fastening sleeve or on the handle holder. Furthermore, a protective function of the vibration damper is achieved owing to the handle holder being arranged to overlap on the outside. All individual components of the vibration damper are covered outwardly by the overlapping region of the handle housing. Dirt, moisture, UV radiation or other disadvantageous ambient influences are kept away from the vibration damper.

In a preferred development, the motor housing has, away from the fastening sleeve, a radially outwardly open circumferential groove in which there engages, with play, a radially inwardly directed annular flange of the handle housing. A high bearing capacity is achieved by the arrangement of the circumferential groove in the circumferential region of the motor housing in cooperation with the annular flange. The fastening sleeve and the annular flange together form a labyrinth seal, which increases the covering protective function for the vibration damper.

In a further expedient embodiment, the handle holder has at least one radially inwardly directed securing projection which engages, with play, in a securing receiver of the fastening sleeve. The position of the handle housing relative to the motor housing is secured indirectly through direct interaction between the handle holder and the fastening sleeve, whilst the space-saving, coaxial structural arrangement, layered in the radial direction, is retained. Here, likewise, a direct, immediate positive locking with play is obtained without additional fastening elements. It is not necessary for the handle housing and the motor housing to interact directly with each other in a securing manner. The vibration damper can be arranged in the form of a ring, with a maximum radius in relation to the longitudinal axis of the appliance, in the region of the outer contour of the motor housing and the handle housing. In the case of the coaxial, radially layered structural design, the external sleeve-like handle holder effects a protective function upon the sensitive damping sleeve.

In a preferred development, the securing projection, together with a radial damping portion of the damping sleeve, is inserted in the securing receiver from the outside inwards, the radial damping portion filling the play between the securing projection and the securing receiver. Accordingly, the play is not an entirely free play, but a play which is permitted by the elastic deformation of the damping portion that projects radially inwards. Gaps, cavities or the like, in which dirt could accumulate and prevent movement, are prevented.

In a preferred development, there is provided between the handle holder and the motor housing in the axial direction an in particular extending around gap, from which an impact edge of the damping sleeve projects radially over the contour of the handle holder and of the motor housing. The damping sleeve thereby performs a multiple function. In the region of the impact edge, the rubber-elastic, soft material of the damping sleeve reduces the load on the appliance in the case of external impact loads or shock loads. The anti-slip, haptic characteristics of the damper material increase the grip of the appliance housing. At the same time, the impact edge also acts as a seal in the extending around gap between the motor housing and the handle housing, such that penetration of dirt and moisture is prevented in an effective manner. Alternatively, or additionally, it is also possible to provide an impact edge which projects over the contour of the handle holder, is arranged on the outside of the handle holder and, in particular, is realized so as to constitute a single piece with the damping sleeve and to be materially homogeneous therewith, which impact edge is conducive to improving the grip and preventing impact stresses.

In an expedient development, the damping sleeve has an axial damping portion, which is located in the axial direction between an end face of the handle holder and an end face assigned to the motor housing. In addition to the coaxially and radially layered portion of the vibration damper, which is subjected primarily to shearing stress during operation, there is also created a portion which is subjected to tensile and compressive stresses. An increased number of degrees of freedom is obtained for structural adaptation of the vibration behavior and damping behavior.

In an advantageous embodiment, the damping sleeve and the handle holder and/or the damping sleeve and the fastening sleeve are realized in a single piece, as a two-component injection-molded component. In addition to a reduction of the resource requirement for production and assembly, in particular positional tolerances of the individual components in relation to each other are avoided. Clearly defined contact surfaces between the individual components can be predefined in a structurally precise manner, and remain constant over a long operating period because penetration by dirt and moisture is avoided. In this case, openings in a sleeve portion of the handle holder and/or of the fastening sleeve are expediently filled by material of the damping sleeve. In addition to an adhesive material connection of the individual components, there is also obtained a positive locking which ensures that the individual components are permanently fixed in position in relation to each other.

In a preferred embodiment, the structural unit consisting of the handle holder and the damping sleeve is realized in the form of two half-shells, which are firmly connected to each other. In particular, a joint plane of the two half-shells is arranged, in relation to the axial direction, at an angle, in particular 90°, relative to a joint plane of two housing shells of the motor housing. The offset arrangement of the two joint planes relative to each other allows the two half-shells to be used also as a connection element for the two housing shells of the motor housing. The assembly resource requirement is reduced. Worn vibration dampers can be replaced through simple replacement of the half-shells realized as single parts. Connection of the two half-shells to each other is expediently realized through screwed connection or by slipping on an outer, circumferential clamping ring.

Exemplary embodiments are described more fully in the following with reference to the drawing, wherein:

FIG. 2 shows a perspective exploded representation of a housing shell of the motor housing according to FIG. 1 in the region of the vibration damper adjoining the motor housing;

FIG. 3 shows the detail III according to FIG. 1, with details relating to the structure of the coaxially constructed and radially layered vibration damper and of a system, encompassing the vibration damper, for directly securing the position of the handle housing to the motor housing;

FIG. 4 shows an exploded representation of a further exemplary embodiment of the invention, with a vibration damper in the form of two separate half-shells and a positional securing system on the fastening sleeve assigned to the motor housing;

FIG. 5 shows a longitudinal sectional representation of the arrangement according to FIG. 4, with details relating to the interaction of the individual components in the region of the vibration damper;

FIG. 6 shows a variant of the arrangement according to FIG. 4, with screw-connected half-shells of the vibration damper;

FIG. 7 shows a sectional representation of the arrangement according to FIG. 6 in the region of the vibration damper, with details of an additional impact edge formed-on in a single piece.

Figure 1:
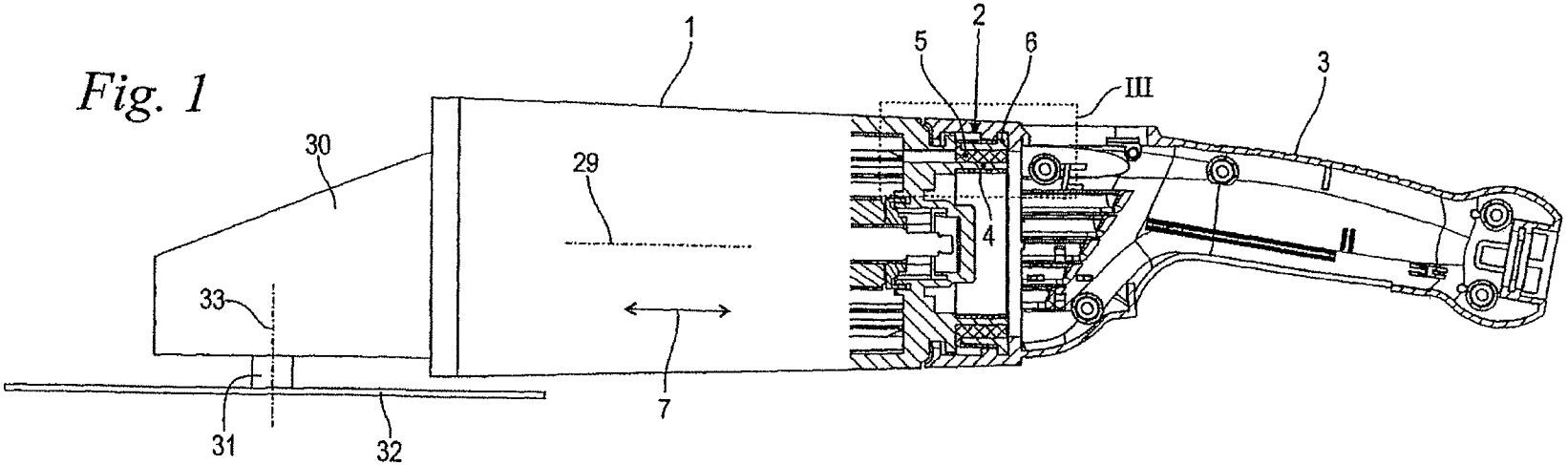
FIG. 1 shows, in a partially sectional side view, a portable power tool according to the invention, using the example of an angle grinder having a first embodiment of the vibration damper.

FIG. 1 shows, using the example of an angle grinder, a partially sectional side view of a portable power tool according to the invention. Arranged in a motor housing 1 of the power tool is an electric motor, not represented in greater detail, which drives a working tool, for example a cutting disk 32, via a bevel gear transmission, likewise not represented, which is arranged in a transmission housing 30. The cutting disk 32 is held on a tool shaft 31 driven in rotation about a rotational axis 33, the rotational axis 33 being approximately at right angles to a longitudinal axis 29 of the approximately cylindrical motor housing 1, which here is slightly conical. Arranged on the end face of the motor housing 1 which is opposite to the transmission housing 30 is a handle housing 3, which can accommodate various control elements for the drive motor and constitutes a rear handle of the power tool.

During operation, the drive motor and the cutting disk 32 produce vibrations, which are transmitted to the motor housing 1 and components mounted thereon. In order to decouple these vibrations from the handle housing 3, the latter is fastened to the motor housing 1 by means of an elastic vibration damper 2. The rubber-elastic vibration damper 2 permits a vibrating relative movement of the motor housing 1 relative to the handle housing 3. Its elastic resilience is designed in such a way that the vibrations are transmitted to the handle 3 only after having been substantially reduced. In addition, there is a damping effect of the rubber-elastic material used in the vibration damper 2.

The position of the handle housing 3 relative to the motor housing 1 defines an axial direction 7 which, in the exemplary embodiment shown, is approximately parallel to the longitudinal axis 29 of the motor housing 1. The handle housing 3 overlaps the vibration damper 2 in the axial direction 7, in the direction of the motor housing 1, and is secured, with play, directly to the motor housing 1. Further details relating thereto are explained more fully in connection with FIGS. 2 and 3. The play between the handle housing 3 and the motor housing 1 permits, on the one hand, a vibration-decoupling relative movement between the two aforementioned assemblies. On the other hand, the system of securing to the motor housing 1 with play prevents the handle housing 3 from becoming detached from the motor housing 1 in the event of the vibration damper 2 becoming worn or damaged.

The vibration damper 2 is comparable in its structure to a tube portion, lying in the axial direction 7, which is arranged approximately coaxially relative to the longitudinal axis 29 and extends around close to the circumferential contour of the motor housing 1 and of the handle housing 3. For this purpose, the vibration damper 2 is constructed from a fastening sleeve 4 assigned to the motor housing 1, an elastic damping sleeve 5 which coaxially encompasses the fastening sleeve 4, and a handle holder 6 which is assigned to the handle housing 3 and likewise coaxially encompasses the fastening sleeve 4 and the damping sleeve 5. The coaxial structure is so selected that the fastening sleeve 4 and the handle holder 6 with the interposed damping sleeve 5 are layered radially from the inside outwards. The handle housing 3 is fixedly connected to the handle holder 6 and, together with the latter, constitutes a structural unit which is substantially rigid overall relative to the rubber-elastic resilience of the damping sleeve. A comparable case applies in respect of the structural unit consisting of the motor housing 1 and the fastening unit 4 projecting from the end of the motor housing 1, which structural unit is likewise substantially rigid relative to the resilience of the damping sleeve 5. The vibration-decoupling and vibration-damping relative movement between the two components is substantially limited to the deformation of the damping sleeve 5.

Instead of the angle grinder shown here, other comparable portable power tools, in particular having an electric-motor drive, such as power drills or the like, can also be provided.

FIG. 2 shows an exploded representation of a single housing shell 26 of the motor housing 1 according to FIG. 1, in the region of the vibration damper 2. An opposing housing shell, not shown here, is constructed according to the same principle so as to be approximately mirror-symmetrical and, in being assembled with the half-shell 26 shown here, is completed to form the motor housing 1 with the formed-on vibration damper 2. It can be seen that the fastening sleeve 4 is realized in a single piece with the motor housing 1. A two-part structural design may also be expedient.

Arranged between the fastening sleeve 4 and the motor housing 1, relative to the axial direction 7, is a radially outwardly open circumferential groove 8, which extends around in the form of a circle and which is delimited by an end wall 35 in the axial direction 7 towards the motor housing 1 and by an extending around, outer annular flange 34 in the opposing direction towards the fastening sleeve 4.

The handle holder 6 comprises a cylindrical sleeve portion 19, adjoining the end face of which, on the side that faces away from the motor housing 1, is an extending around, outer annular flange 36 which extends radially outwards. The fastening sleeve 4 and the sleeve portion 19 of the handle holder 6 are provided with a number of openings 20, 21. According to the representations according to FIGS. 1 and 3, the damping sleeve 5, the handle holder 6 and the fastening sleeve 4 are realized in a single piece, as a two-component injection-molded component, the sleeve portion 19 of the handle holder 6 and the fastening sleeve 4 being encompassed on both sides in the radial direction by material of the damping sleeve 5. During the injection molding process, the material of the damping sleeve 5 penetrates the openings 20, 21, whereby an intimate, positive-locking connection of the damping sleeve 5 to the fastening sleeve 4 and to the handle holder 6 is produced. In combination with the motor housing 1 being designed to constitute a single part with the fastening sleeve 4 and to be materially homogeneous therewith, the housing shell 26 shown is realized so as to constitute a single part, as a two-component injection-molded part, with an assigned half-shell of the vibration damper 2. It may also be expedient, with appropriate geometric design, for the fastening sleeve 4, the damping sleeve 5 and the handle holder 6 to be produced as single parts that are separate from each other.

FIG. 3 shows an enlarged view of the detail III according to FIG. 1, with the motor housing 1 shown in FIG. 2 and the vibration damper 2, likewise shown therein, in the assembled state. According to this figure, it can be seen that the damping sleeve 5 is realized with an approximately S-shaped cross-section, the fastening sleeve 4 being completely encompassed on the inside and outside in the radial direction by the material of the damping sleeve 5. The same also applies to the sleeve portion 19 of the handle holder 6, the greater material cross-section of the damping sleeve 5 being located between the fastening sleeve 4 and the handle holder 6 in the radial direction in order to produce the required elastic resilience. The outer annular flange 34 and the sleeve portion 19 of the handle holder 6 have end faces 18, 17 which face towards each other at a distance and between which there is located, without play, an axial damping portion 16 of the damping sleeve 5 which is formed-on in a single piece and which is provided to absorb compressive stresses running in the axial direction 7.

The outer annular flange 36 of the handle holder 6 projects in the radial direction over the material of the damping sleeve 5 and engages without play in an inner annular groove 37 of the handle housing 3. The handle holder 6 is realized so as to be separate from the handle housing 3. Owing to the fact that the outer annular flange 36 engages without play in the inner annular groove 37, a substantially rigid and immovable connection is produced between the handle housing 3 and the handle holder 6. An embodiment allowing a variable rotational angle position of the handle housing 3 relative to the handle holder 6 about the longitudinal axis 29 shown in FIG. 1 may also be expedient, the interaction of the outer annular flange 36 and the inner annular groove 37 producing a deflection-resistant connection between the handle housing 3 and the handle holder 6.

It can also be seen from the representation according to FIG. 3 that the vibration damper 2 extends around radially outwards, close to the circumferential contour of the motor housing 1 and of the handle housing 3, and is overlapped on the outside, in the axial direction 7 towards the motor housing 1, by a portion of the handle housing 3, which portion is represented in section. Without further mechanical connection of the handle housing 3 to the vibration damper 2, the handle housing 3, at its end which faces towards the motor housing 1, on the inside of its circumferential wall represented in section, carries a radially inwardly directed, extending around annular flange 9, which engages with free play in the circumferential groove 8 of the motor housing 1. The annular flange 9 lies with a radial spacing from the base of the circumferential groove 8 and with an axial spacing from, respectively, the end wall 35 and the outer annular flange 34. The radially inwardly directed annular flange 9 engages so deeply in the circumferential groove 8, however, that it overlaps with the outer annular flange 34 of the motor housing 1, relative to the axial direction 7. The axial and radial play between the annular flange 9 and the circumferential groove 8 permits a freely vibrating relative movement of the assembly consisting of the motor housing 1 and the fastening sleeve 4 relative to the assembly consisting of the handle housing 3 and the handle holder 6. In the event of wear, damage or even breakage of the fastening sleeve 4, the damping sleeve and/or the handle holder 6, the handle housing 3 is secured directly to the motor housing 1 so as to prevent detachment, in that the annular flange 9 engages in a positive-locking manner, with play, in the circumferential groove 8.

FIG. 4 shows a further exemplary embodiment of the invention, wherein a perspectively represented motor housing 1, corresponding to the representation according to FIG. 1, and a vibration damper 2, comprising two half-shells 22, 23, are provided. The motor housing 1 consists of two housing shells 26, 27. A parting line 41 denotes a joint plane 25, represented in greater detail in FIG. 5, between the two housing shells 26, 27. A respective annular flange 38, 39, projecting radially outwards, is provided on both sides of the fastening sleeve 4 relative to the axial direction 7. Between the two annular flanges 38, 39, the fastening sleeve 4 is provided, at two diametrically opposite locations, with a securing receiver 11 in the form of a through-opening.

The two half-shells 22, 23 of the vibration damper 2, between which there is a joint plane 24, are separate from the motor housing 1. The two half-shells 22, 23 are each realized in a single piece, as a two-component injection-molded component, separately from the handle housing 3 (FIG. 1) and from the motor housing 1, and comprise half-shells of the damping sleeve 5 and of the handle holder 6. The damping sleeve 5 and the handle holder 6 can also be produced separately from each other in the form of individual half-shells. Both half-shells 22, 23 are provided, centrally on their inside, with a respective securing projection 10 which projects radially inwards and which, in the assembled state, engages in the assigned securing receiver 11 of the fastening sleeve 4. In order to firmly connect the two half-shells 22, 23 to each other, there is provided an extending around, approximately cylindrical clamping ring 28 which, in the assembled state, comes to lie on an assigned extending around cylindrical outer face 40 of the two half-shells 22, 23.

FIG. 5 shows, in a longitudinal sectional representation, the arrangement according to FIG. 4 in the assembled state. The two diametrically opposing securing projections 10 of the sleeve-shaped handle holder 6 are directed radially inwards, and engage from the outside inwards, with play, in the respectively assigned securing receiver 11 of the fastening sleeve 4. Here, likewise, a free radial and axial play between the securing projection 10 and the securing receiver 11, comparable to the free play between the annular flange 9 and the circumferential groove 8 according to FIG. 3, may be expedient.

In the exemplary embodiment shown, the two securing projections 10, together with a radial damping portion of the damping sleeve 5, are guided from the outside inwards through the securing receiver 11. The radially inwardly projecting damping portion 12 of the damping sleeve 5 thereby encompasses the securing projection 10 completely and, together with the latter, projects into the inside of the fastening sleeve 4. The radial damping portion 12 fills the play between the securing projection 10 and the securing receiver 11 and, owing to its elastic resilience, permits a relative movement of the rigid structural unit consisting of the motor housing 1 and the fastening sleeve 4 relative to the rigid structural unit consisting of the handle housing 3 (FIG. 1), not shown here, and the handle holder 6. The engagement of the securing projection 10 in the securing receiver 11, which engagement extends in the radial direction, produces a positive locking, with play, which, in the event of failure of the damping sleeve 5, secures the structural unit consisting of the handle housing 3 (FIG. 1) and the handle holder 6 to the structural unit consisting of the motor housing 1 and the fastening sleeve 4 so as to prevent detachment.

Provided between the handle holder 6 and the motor housing 1, relative to the axial direction 7, there is an extending around gap 13, which is filled by the material, formed-on in a single piece, of the rubber-elastic damping sleeve 5. The material of the damping sleeve 5 in this case is shaped so as to constitute an extending around impact edge 15, of rounded cross-section, which projects over the contour of the handle holder 6 and of the motor housing 1. Also constituted thereby at the same time is an axial damping portion 16 of the damping sleeve 5, which damping portion lies in an elastically resilient manner between end faces 17, 18 of the motor housing 1 and of the handle holder 6, respectively. In addition to a sealing effect, absorption of compressive stresses acting in the axial direction 7 is also achieved. In addition, the space that is delimited in the axial direction 7 by the two annular flanges 38, 39 and in the radial direction by the circumferential wall of the handle holder 6 and by the fastening sleeve 4 is filled, at least approximately completely, by the material of the damping sleeve 5. In this case, the two annular flanges 38, 39 are also completely encompassed by the material of the damping sleeve 5.

It can also be seen from the representation according to FIG. 5 that the joint plane 24 between the two half-shells 22, 23 of the vibration damper 2 is offset, relative to the longitudinal axis 29, by 90° relative to the joint plane 25 between the two housing shells 26, 27 of the motor housing 1 that are represented in FIG. 4. Here, the joint plane 25 lies in the plane of the drawing, whereas the joint plane 24 is perpendicular thereto. On the outside, the clamping ring 28 extends around the two half-shells 22, 23 of the vibration damper 2 and holds them together. Since the two half-shells 22, 23 firmly encompass the fastening sleeve 4 that is formed onto the motor housing 1 in a single piece, these half-shells also hold the two housing shells 26, 27 (FIG. 4) of the motor housing 1 together in the region of the fastening sleeve 4.

Independently of the previously described holding function of the half-shells 22, 23, it may also be advantageous, in the embodiment shown here and also in the further disclosed embodiments, to provide a single-piece, pot-shaped motor housing 1 (FIG. 1) instead of the two housing shells 26, 27 (FIG. 4).

An outer face of the clamping ring 28 is approximately in alignment with an outer face of the motor housing 1 and of the handle housing 3 (FIG. 1), and can also serve as a gripping surface for the user. For this purpose, an appropriate surface texturing or non-slip coating of the outer face of the clamping ring 28 may be expedient.

The handle housing 3, which is not shown here but which is represented in FIG. 1, is held on the outer annular flange 36 of the handle holder 6, in accordance with the representation according to FIG. 3, but in the axial direction extends only as far as the clamping ring 28. In this case, the two components have at least approximately the same circumferential contour. The handle housing 3, by means of its inner annular groove 37 (FIG. 3), extends, so as to be rotatable about the longitudinal axis 29, on the outer annular flange 36 shown here. For the purpose of locking the selected rotational position, a number of notches 45 are formed in the free end face of the handle holder 6.

In the remaining features and references, the exemplary embodiment according to FIGS. 4 and 5 corresponds with that according to FIGS. 1 to 3.

FIGS. 6 and 7 show a variant of the arrangement according to FIGS. 4 and 5, according to which variant a screwed connection of the two half-shells 22, 23 to each other is provided. It can be seen from the exploded representation according to FIG. 6 that the two half-shells 22, 23 are constructed so as to be rotationally symmetrical relative to each other, and have a respective hollow pin 42 and a bore 43 on their mutually facing end faces. In the assembled state, the respective hollow pin 42 engages in the opposing bore 43. A respective screw 44 is introduced into the two bores 43 tangentially from the outside inwards and screwed into the hollow pin 42, whereby a firm connection of the two half-shells 22, 23 to each other and to the motor housing 1 is produced.

It can also be seen from the longitudinal sectional representation according to FIG. 7 that there is provided in the gap 13 between the motor housing 1 and the vibration damper 2, in addition to the impact edge 14, another, further impact edge 15, which is realized to constitute a single piece with the damping sleeve 5 of the vibration damper 2 and to be materially homogeneous therewith. The impact edge 15 projects outwards over the contour of the handle holder 6 in the radial direction and extends around the handle holder 6, on the outside of the cylindrical outer face 40. By means of openings, not shown, in the handle holder 6, which are filled by the material of the impact edge 15 and of the damping sleeve 5, the impact edge is connected to the damping sleeve 5 in a single piece. In the remaining features and references, the exemplary embodiment according to FIGS. 6 and 7 corresponds with that according to FIGS. 4 and 5.

The invention claimed is:

1. A portable power tool comprising:

a motor housing; and a handle housing fastened to the motor housing by an elastic vibration damper and secured to the motor housing in a positive-locking manner, wherein the vibration damper includes:

a fastening sleeve assigned to the motor housing, an elastic damping sleeve which coaxially encompasses the fastening sleeve, and a handle holder which coaxially encompasses the fastening sleeve and the damping sleeve and is assigned to the handle housing, wherein a first substantially rigid structural unit includes the handle holder and the handle housing and is directly secured in a positive-locking manner, with play, to a second substantially rigid structural unit that includes the fastening sleeve and the motor housing, wherein the damping sleeve and the handle holder each include a half-shell, wherein the half-shells of the damping sleeve and the handle holder each form a single, unitary-piece from two-injection-molded components, wherein the single, unitary piece is separate from the handle housing and from the motor housing, and wherein a portion of the handle housing extends over a surface of the motor housing.

2. The portable power tool as claimed in claim 1, wherein the handle housing overlaps the vibration damper in an axial direction in a direction of the motor housing, and is directly secured, with play, in a positive-locking manner to the motor housing.

3. The portable power tool as claimed in claim 2, wherein the motor housing includes a radially outwardly open circumferential groove positioned away from the fastening sleeve and wherein the radially outwardly open circumferential groove engages, with play, to a radially inwardly directed annular flange of the handle housing.

4. The portable power tool as claimed in claim 1, wherein the handle holder includes at least one radially inwardly directed securing projection which engages, with play, in a securing receiver of the fastening sleeve.

5. The portable power tool as claimed in claim 4, wherein the securing projection and a radial damping portion of the damping sleeve are configured to be inserted into the securing receiver from the outside inwards and wherein the radial damping portion fills the play between the securing projection and the securing receiver.

6. The portable power tool as claimed in claim 4, further comprising:

an extending around gap provided between the handle holder and the motor housing in an axial direction; and an impact edge of the damping sleeve that projects radially over a contour of the handle holder and of the motor housing.

7. The portable power tool as claimed in claim 4, further comprising:

an impact edge configured to project over a contour of the handle holder, wherein the impact edge is arranged on an outside of the handle holder and constitutes a single piece with the damping sleeve, and wherein the impact edge and the damping sleeve arc composed of the same material.

8. The portable power tool as claimed in claim 1, wherein the damping sleeve includes an axial damping portion located in an axial direction between an end face of the handle holder and an end face assigned to the motor housing.

9. The portable power tool as claimed in claim 1, wherein the damping sleeve and the handle holder form a single, unitary-piece from two injection-molded components separate from the handle housing.

10. The portable power tool as claimed in claim 9, wherein the damping sleeve, the handle holder, and the fastening sleeve form a single, unitary-piece from two injection-molded components, wherein a sleeve portion of the handle holder and the fastening sleeve are surrounded on both sides in a radial direction by a material of the damping sleeve, and wherein the sleeve portion and the fastening sleeve include openings filled by the material of the damping sleeve.

11. The portable power tool as claimed in claim 1, wherein the damping sleeve, the fastening sleeve, and the motor housing form-a single piece, two-component injection-molded component.

12. The portable power tool as claimed in claim 1, wherein the handle holder and the damping sleeve of the second substantially rigid structural unit are firmly connected to each other.

13. The portable power tool as claimed in claim 12, wherein a joint plane of the half-shells is positioned, in relation to an axial direction, at an angle, in particular 90° , relative to a joint plane of two housing shells of the motor housing.

14. The portable power tool as claimed in claim 12, wherein the half-shells are screwed together.

15. The portable power tool as claimed in claim 12, wherein the half-shells are connected to each other by an outer, extending around clamping ring.

16. The portable power tool as claimed in claim 1, wherein the handle housing is configured to rotate relative to the handle holder.

17. The portable power tool as claimed in claim 1, wherein the portion of the handle housing extends over the surface of the motor housing at the location of the direct, positive-locking securement.

18. The portable power tool as claimed in claim 1, wherein the first substantially rigid structural unit is directly secured in a positive-locking manner in a longitudinal or axial direction, with play, to the second substantially rigid structural unit.

* * * * *